US009327162B2

(12) United States Patent
Huang

(10) Patent No.: US 9,327,162 B2
(45) Date of Patent: May 3, 2016

(54) EXERCISE APPARATUS

(71) Applicant: GIANT LION CO., LTD., Changhua County (TW)

(72) Inventor: Chin-Lin Huang, Changhua County (TW)

(73) Assignee: Giant Lion Co., Ltd., Changhua County (TW)

( * ) Notice: Subject to any disclaimer, the term of this patent is extended or adjusted under 35 U.S.C. 154(b) by 37 days.

(21) Appl. No.: 14/247,378

(22) Filed: Apr. 8, 2014

(65) Prior Publication Data

US 2015/0283423 A1 Oct. 8, 2015

(51) Int. Cl.
*A63B 22/06* (2006.01)
*A63B 21/015* (2006.01)

(52) U.S. Cl.
CPC ..... *A63B 22/06* (2013.01); *A63B 21/015* (2013.01)

(58) Field of Classification Search
CPC .. A63B 22/06; A63B 21/015; A63B 21/4033; A63B 21/4034; A63B 69/16; A63B 2022/0611; A63B 2022/0623; A63B 2022/0635; A63B 2022/0641; A63B 22/0605
See application file for complete search history.

(56) References Cited

U.S. PATENT DOCUMENTS

| | | | | |
|---|---|---|---|---|
| 6,474,193 | B1 * | 11/2002 | Farney | A63B 22/0605 74/594.3 |
| 7,004,888 | B1 * | 2/2006 | Weng | A63B 21/0051 482/57 |
| 7,419,458 | B2 * | 9/2008 | Forcillo | A63B 21/015 482/119 |
| 8,834,324 | B2 * | 9/2014 | Lull | A63B 21/015 482/15 |
| 2012/0065029 | A1 * | 3/2012 | Dunlap | A63B 21/227 482/62 |
| 2013/0203563 | A1 * | 8/2013 | Chen | A63B 22/0605 482/63 |
| 2015/0045190 | A1 * | 2/2015 | Keiser | A63B 21/0051 482/57 |

* cited by examiner

*Primary Examiner* — Loan H Thanh
*Assistant Examiner* — Megan Anderson
(74) *Attorney, Agent, or Firm* — Rosenberg, Klein & Lee

(57) ABSTRACT

An exercise apparatus includes a main device having a handle member and a seat member, the main device having a driver set rotatably assembled, the driver set having a first driver member, the first driver member having a plurality of first driver units, the driver set having two pedals assembled at two sides thereof, the main device having a wheel member rotatably assembled thereon, a second driver member assembled at an axle of the wheel member, the second driver member having a plurality of second driver units, a first connecting member connecting the first driver member and the second driver member so as to drive the wheel member to rotate, the first connecting member mounted around one first driver unit and one second driver unit, a resistance device assembled on the main device, the resistance device configured to create a resistance force to the wheel member.

7 Claims, 7 Drawing Sheets

EXERCISE APPARATUS

BACKGROUND OF THE INVENTION

1. Field of the Invention

The present invention relates to an apparatus, and more particularly to an exercise apparatus.

2. Description of the Prior Art

As well known knowledge, when a user uses an exercise apparatus, the exercise apparatus operates repeatedly via an operating mechanism which moves in circles. In the same time, a resistance device provides a resistance force to the operating mechanism. Therefore, the user repeatedly puts forth his or her strength onto the operating mechanism, so as to overcome the resistance force. Based on said theory, a conventional exercise apparatus comprises an operating mechanism and a resistance device. The operating mechanism is connected to the resistance device via a transmitting device, such as a belt or a chain. However, a conventional exercise apparatus has some advantages as follows. Because the transmitting device of the conventional exercise apparatus is too complicated to reduce the manufacturing cost of the conventional exercise apparatus. Moreover, every parts of the transmitting device need higher precision to be assembled to each other, so that an assembling of the transmitting device is hard.

In addition, when a user uses the conventional stationary exercise apparatus, the user adjusts the resistance force form the resistance device, so that the user puts forth his or her strength of various magnitudes onto the operating mechanism. However, the user always just repeats one physical activity indoors, so that the user cannot feel that he or she is riding a real bicycle outdoors. Therefore, the user may feel boring during exercise.

The present invention is, therefore, arisen to obviate or at least mitigate the above mentioned disadvantages.

SUMMARY OF THE INVENTION

An object of the present invention is to provide an apparatus.

To achieve the above and other objects, an exercise apparatus comprises a main device having a handle member and a seat member assembled thereon, the main device having a driver set rotatably assembled thereon, the driver set having a first driver member, the first driver member having a plurality of first driver units which are of various sizes and are coaxial, the driver set having two pedals assembled at two sides thereof, the two pedals configured for a user to tread on to rotate the driver set, the main device having a wheel member rotatably assembled thereon, a second driver member assembled at an axle of the wheel member, the second driver member having a plurality of second driver units which are of various sizes and are coaxial, a first connecting member connecting the first driver member and the second driver member so as to drive the wheel member to rotate, the first connecting member mounted around one first driver unit and one second driver unit, the first connecting member shifted from one position to another position by a shifting device, so as to be mounted around another first driver unit or another second driver unit.

A resistance device is assembled on the main device; the resistance device is configured to create a resistance force to the wheel member.

Wherein the resistance force created by the resistance device is adjustable; the wheel member is made of metal material; the resistance device is magnetic and doesn't contact the wheel member; a controller member drives the resistance device to move toward or from the wheel member so as to adjust the resistance force.

A brake device is assembled near the wheel member; the brake device is configured to reduce the speed of the rotation of the wheel member.

The seat member is assembled on the main device via a seat tube member; the seat tube member is axially movable relative to the main device, so that the user can adjust a position of the seat member on the main device; the handle member is assembled on the main device via a handle tube member; the handle tube member is axially movable relative to the main device, so that the user can adjust a position of the handle member on the main device.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
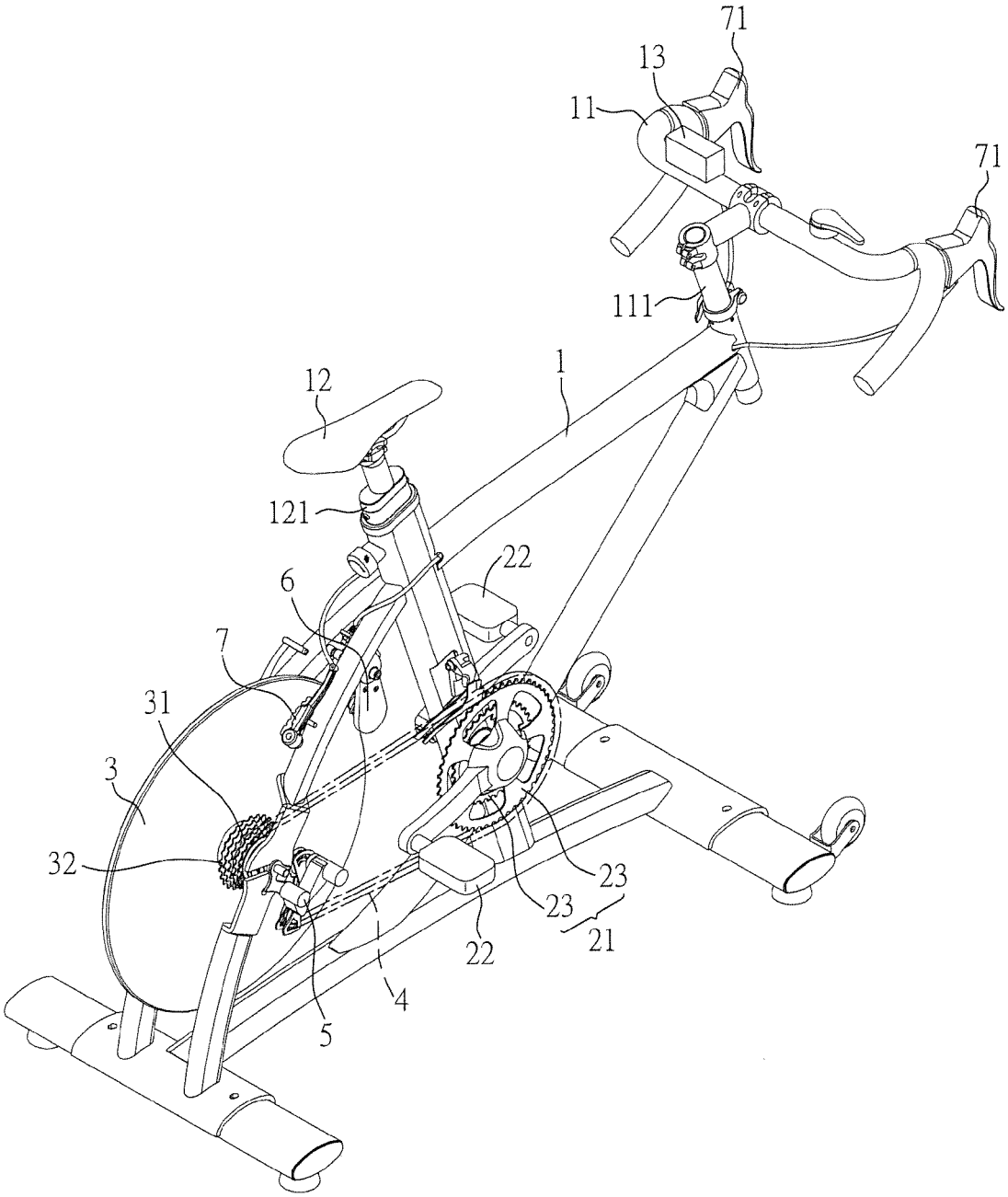
FIG. 1 is a perspective view of a first embodiment of the present invention.

Referring to FIG. 1, a first embodiment of the present invention is described as follows. An exercise apparatus in accordance with the present invention comprises a main device 1 and a resistance device. The main device 1 is illustrated as a bike frame. The main device 1 has a handle member 11 assembled at a front end thereof. The main device 1 has a seat member 12 assembled at a rear end thereof. The handle member 11 is configured for a user to hold. The seat member 12 is configured for the user to sit on. The handle member 11 is assembled on the main device 1 via a handle tube member 111. The handle tube member 111 is axially movable relative to the main device 1, so that the user can adjust a position of the handle member 11 on the main device 1. The seat member 12 is assembled on the main device 1 via a seat tube member 121. The seat tube member 121 is axially movable relative to the main device 1, so that the user can adjust a position of the seat member 12 on the main device 1. Therefore, the user can adjust the position of the handle member 11 or the seat member 12 so as to fit himself or herself.

The main device 1 has a driver set 2 assembled under the seat member 12. The driver set 2 has a first driver member 21. The first driver member 21 has a plurality of first driver units which are of various sizes and are coaxial. The driver set 2 has two pedals 22 assembled at two sides thereof. The two pedals 22 are configured for the user to tread on to rotate the driver set 2. The first driver units are defined as a plurality of chainrings 23 which are of various sizes. The chainrings 23 are coaxially assembled on the driver set 2. The main device 1 has a wheel member 3 rotatably assembled at the rear end thereof. A second driver member 31 is assembled at an axle of the wheel member 3. The second driver member 31 has a plurality of second driver units which are of various sizes and are coaxial. The second driver units are defined as a plurality of gear wheels 32. A first connecting member connects the first driver member 21 and the second driver member 31. The first connecting member is defined as a chain 4. The chain 4 is mounted around one chainring 23 of the first driver member 21 and one gear wheel 32 of the second driver member 31. The chain 4 is configured to drive the wheel member 3 to rotate. Specially, when the user tread on the two pedals 22, the driver set 2 is driven to rotate. Then, the rotation of one chainring 23 of the first driver member 21 drives one gear wheel 32 of the second driver member 31 to rotate via the chain 4. As a result, the wheel member 3 is rotated by the rotation of one gear wheel 32. The chain 4 is shifted from one position to another position by a shifting device, so as to be mounted around another chainring 23 or another gear wheel 32. Therefore, the user can tread on the two pedals 22 with variable pressure to rotate the wheel member 3. The shifting device is defined as a derailleur 5.

Figure 2:
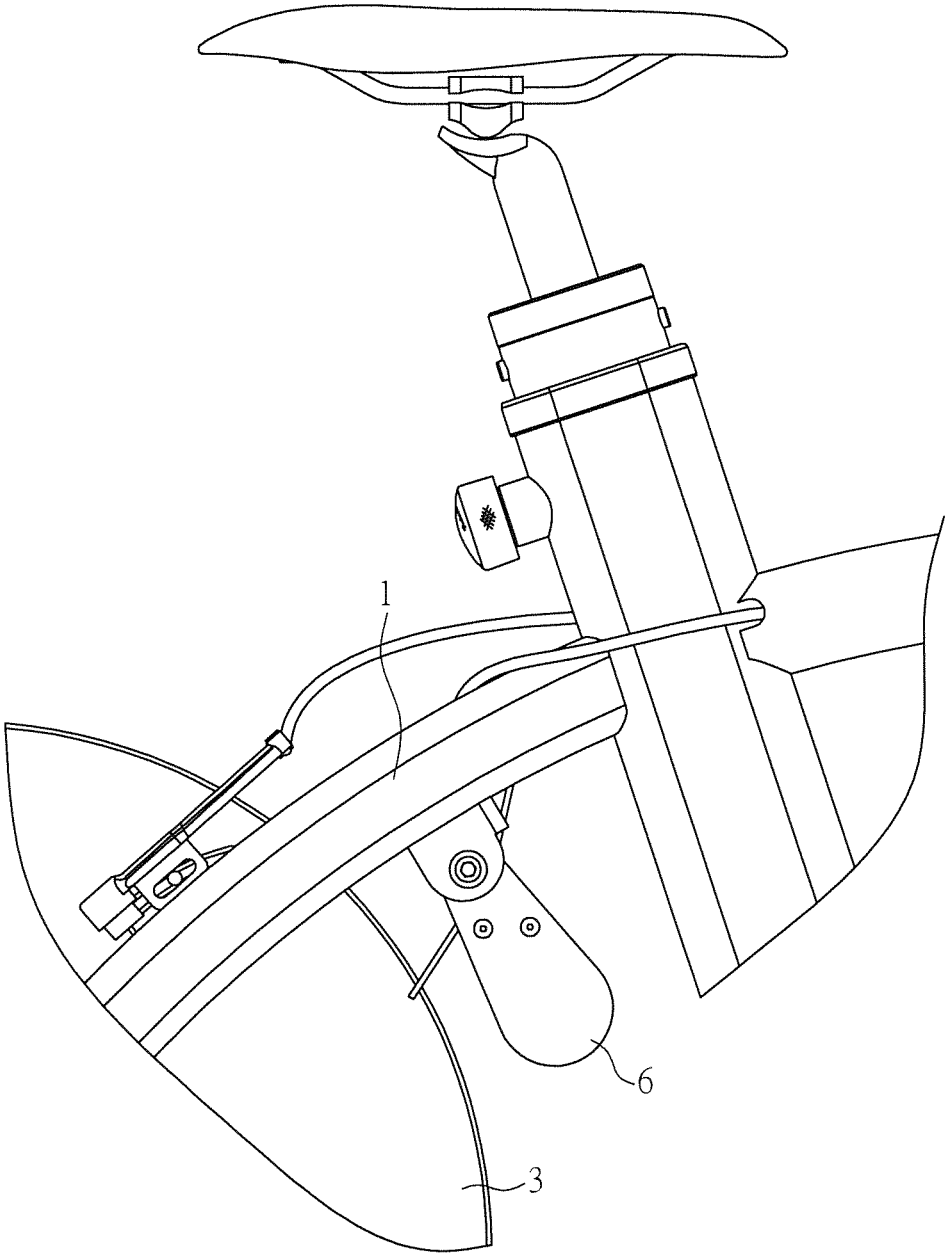
FIGS. 2-3 are enlarged views for showing an operation of a resistance device.
Figure 3:
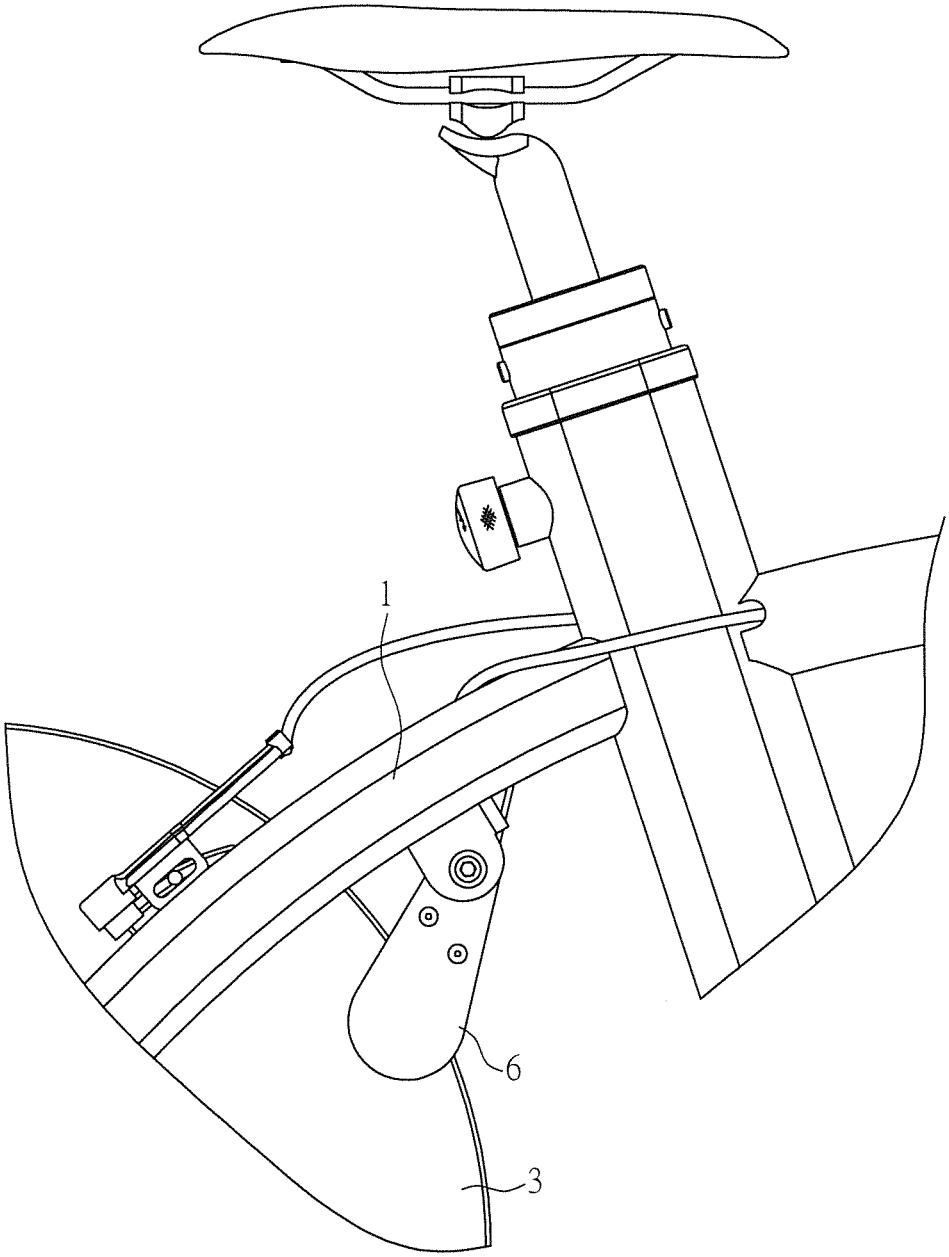

The resistance device is assembled on the main device 1. The resistance device is close to the wheel member 3. The resistance device is configured to create a resistance force to the wheel member 3. Specially, the resistance device is defined as a magnetic member 6 and the wheel member 3 is made of metal material. The magnetic member 6 is rotatably assembled on the main device 1. The magnetic member 6 is close to the wheel member 3 and doesn't contact the wheel member 3. The magnetic member 6 creates a magnetic force to the wheel member 3. When the wheel member 3 rotates, the magnetic force restrains the rotation of the wheel member 3. The magnitude of the magnetic force depends on the speed of the rotation of the wheel member 3 and the distance between the wheel member 3 and the magnetic member 6. When the user treads on the two pedals 22 with larger pressure and increases the speed of the rotation of the wheel member 3, the magnitude of the magnetic force would be enlarged. When the distance between the wheel member 3 and the magnetic member 6 is decreased, the magnitude of the magnetic force would be also enlarged. Specially, a controller member 13 is assembled on the handle member 11. The controller member 13 is electrically connected to the magnetic member 6. Referring to FIGS. 2-3, the controller member 13 drives the magnetic member 6 to swing, so that the magnetic member 6 is moved toward or from the wheel member 3 so as to adjust the distance between the wheel member 3 and the magnetic member 6. Under this arrangement, the present invention allows the user to adjust a level of training via adjusting the magnitude of the magnetic force. The user can tread on the two pedals 22 with variable pressure to rotate the wheel member 3, by adjusting the magnitude of the magnetic force or shifting the position of the chain 4. Therefore, the present invention has the user feel that he or she is riding a real bicycle. When the magnitude of the magnetic force is enlarged, the user feels that he or she is riding on an uphill path. A brake device 7 is assembled near the wheel member 3. A controller 71 is assembled on the handle member 11 and is connected to the brake device 7 so as to control the brake device 7. The user can reduce the speed of the rotation of the wheel member 3 via manipulating the controller 71. Therefore, the present invention has the user feel that he or she is riding a real bicycle.

Figure 4:
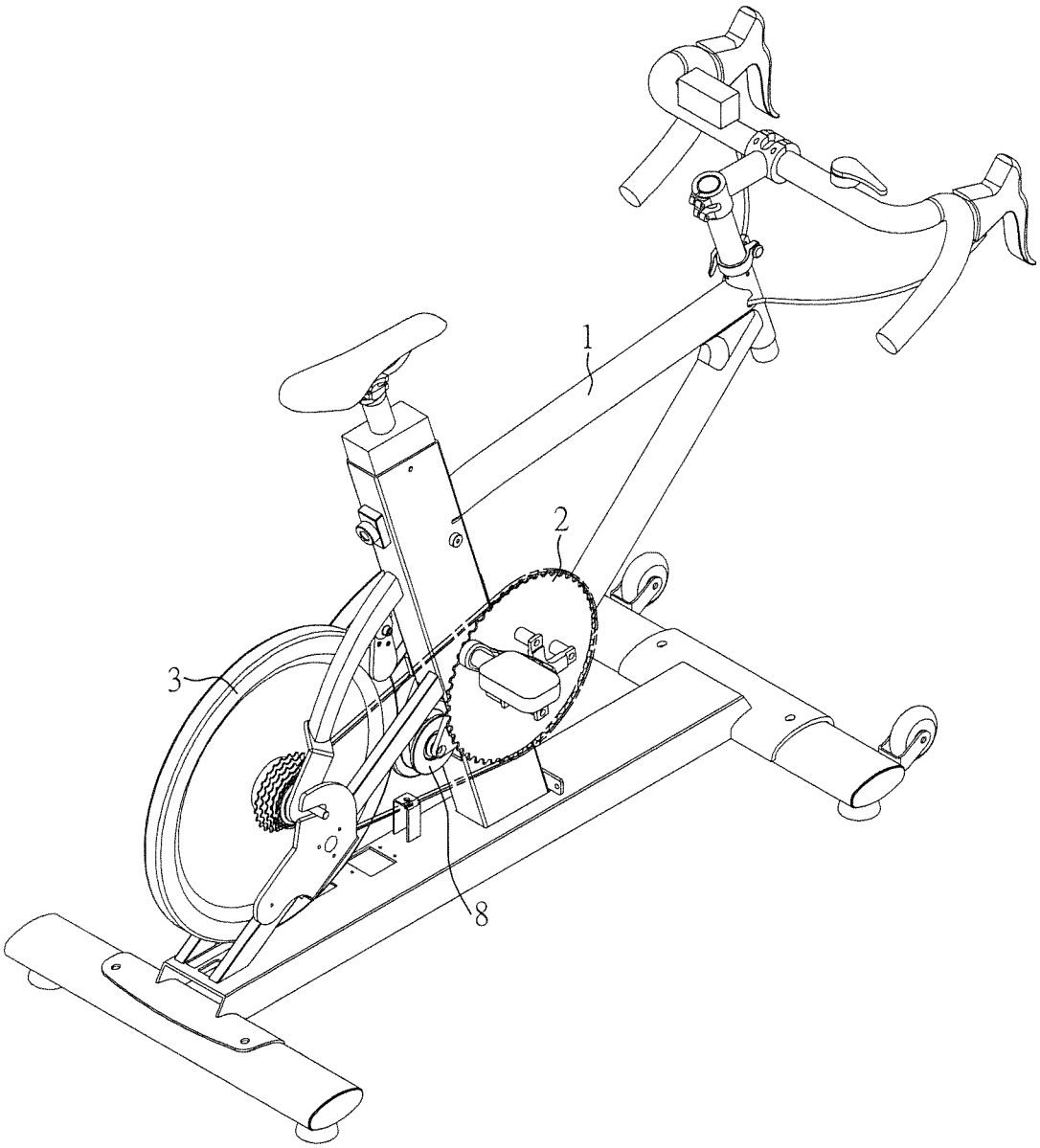
FIG. 4 is a perspective view of a second embodiment of the present invention.
Figure 5:
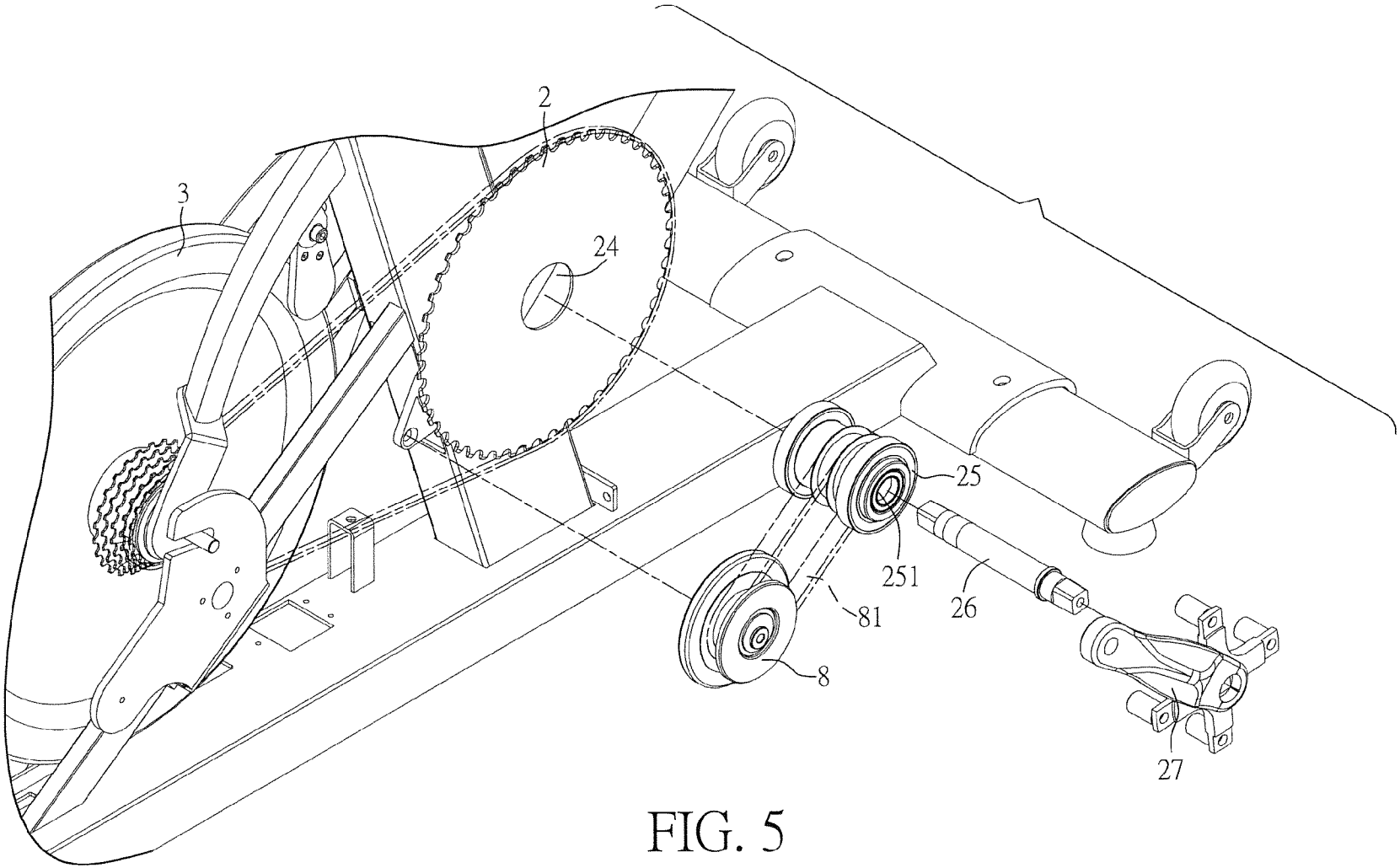
FIG. 5 is a partially exploded view of the second embodiment.
Figure 6:
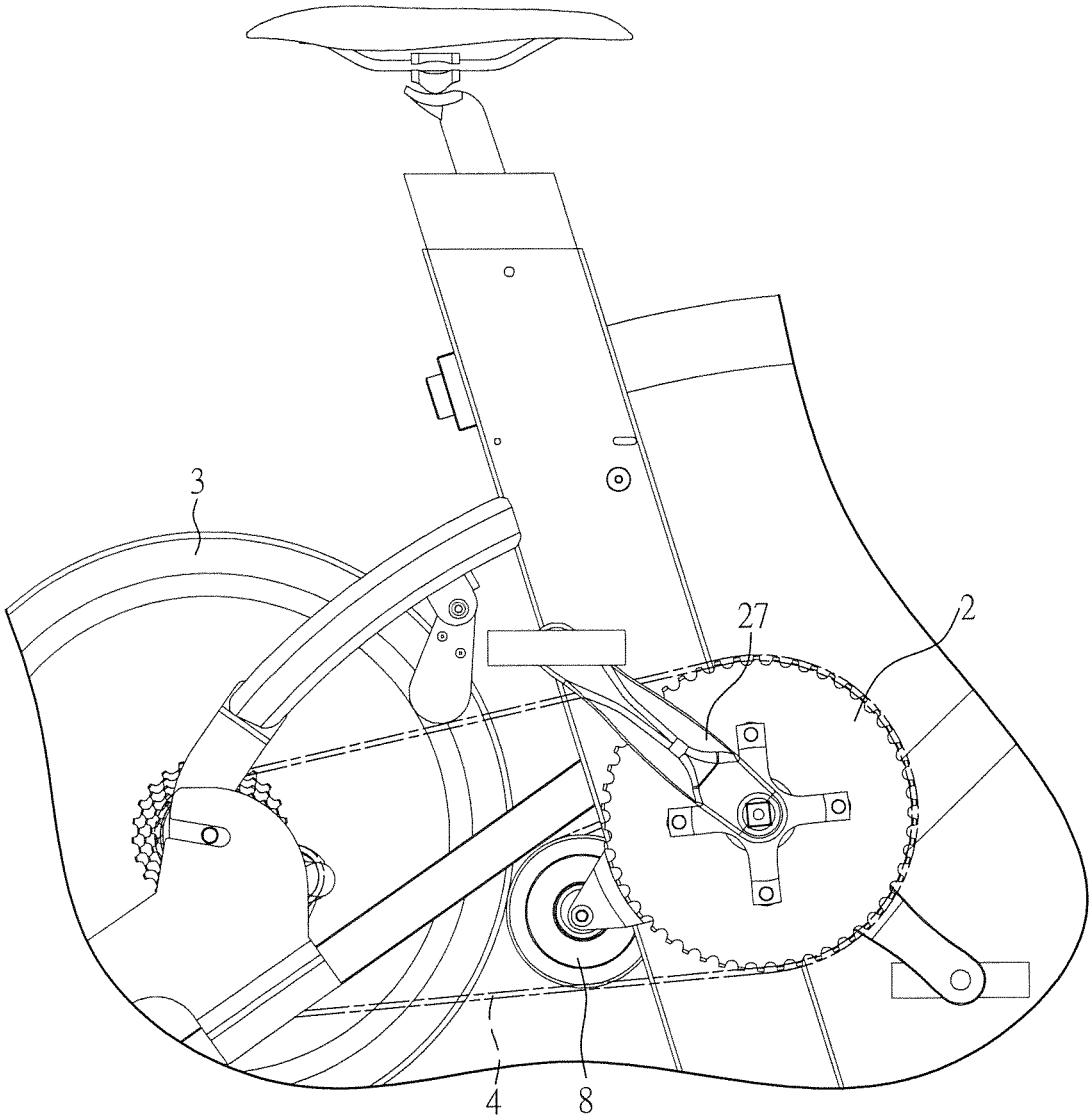
FIG. 6 is a side view of the second embodiment.

Referring to FIGS. 4-6, a second embodiment of the present invention is described as follows (only the difference between the second embodiment and the first embodiment is described herein). The driver set 2 has a central hole 24 formed therethrough at the center thereof. A rotating member 25 is rotatably assembled at the central hole 24. The rotating member 25 has a through hole 251 formed therethrough. A distance D is defined between a center of the through hole 251 and a center of the rotating member 25. A spindle 26 passes through the through hole 251. Two crank arms 27 are respectively connected to two ends of the spindle 26. A flywheel 8 is rotatably assembled on the main device 1. A surface of the flywheel 8 contacts a surface of the wheel member 3. The flywheel 8 is rotated by the rotation of the wheel member 3. A second connecting member connects the flywheel 8 and the rotating member 25. Specially, the second connecting member is defined as a belt 81. The belt 81 is configured to drive the rotating member 25 to rotate.

Figure 7:
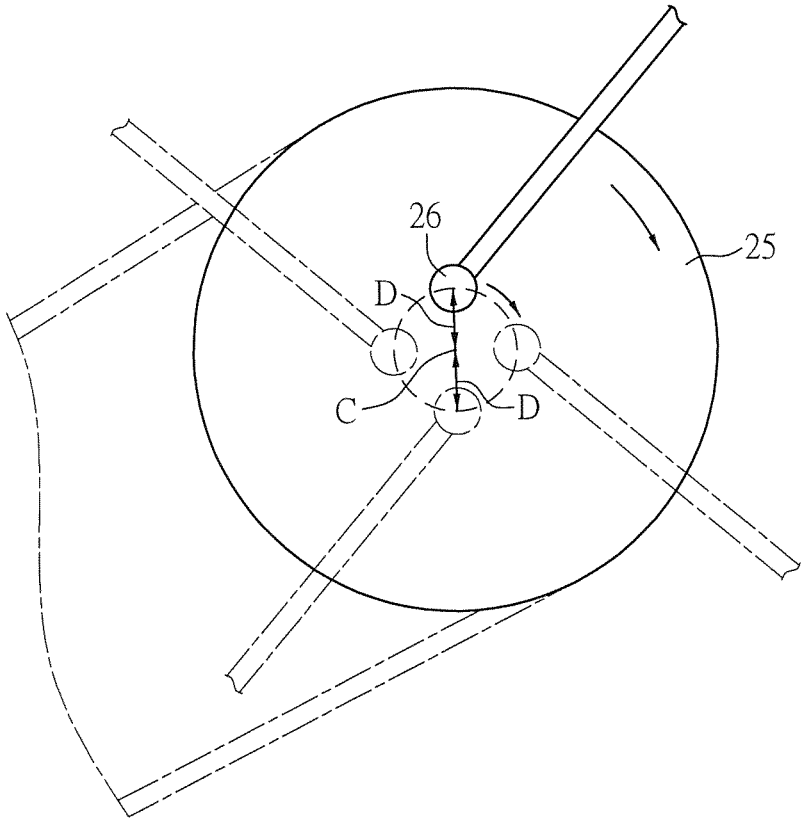
FIG. 7 is a cross-sectional view of the second embodiment for showing an operation of a rotating member.

When the user tread on the two pedals, the wheel member 3 is driven to rotate. Then, the flywheel 8 is rotated by the rotation of the wheel member 3. Thereafter, the rotating member 25 is rotated around a rotation center C thereof by the rotation of the flywheel 8 via the belt 81. As a result, the spindle 26 is moved along a circle track which is defined by the distance D (as shown in FIG. 7). Clearly, the distance D acts as a radius of the circle track. Double distance D is a maximum distance between the positions of the spindle 26. Therefore, the present invention has the user feel that he or she is riding on a bumpy path.

Furthermore, the flywheel 8 can be removed from the wheel member 3 (how to remove the flywheel 8 from the wheel member 3 is well known, so that it's not described herein). When the flywheel 8 is removed from the wheel member 3, the uncomfortable feeling would be disappeared, so that the user feels that he or she is riding on a smooth path.

Although particular embodiments of the invention have been described in detail for purposes of illustration, various modifications and enhancements may be made without departing from the spirit and scope of the invention. Accordingly, the invention is not to be limited except as by the appended claims.

The invention claimed is:

1. An exercise apparatus comprising:

a main device having a handle member and a seat member assembled thereon, the main device having a driver set rotatably assembled thereon, the driver set having a first driver member, the first driver member having a plurality of first driver units which are of various sizes and are coaxial, the driver set having two pedals assembled at two sides thereof, the two pedals configured for a user to tread on to rotate the driver set, the main device having a wheel member rotatably assembled thereon, a second driver member assembled at an axle of the wheel member, the second driver member having a plurality of second driver units which are of various sizes and are coaxial, a first connecting member connecting the first driver member and the second driver member so as to drive the wheel member to rotate, the first connecting member mounted around one first driver unit and one second driver unit, the first connecting member shifted from one position to another position by a shifting device, so as to be mounted around another first driver unit or another second driver unit; and a resistance device assembled on the main device, the resistance device configured to create a resistance force to the wheel member;

wherein the driver set has a central hole formed therethrough at the center thereof; a rotating member is rotatably assembled at the central hole; the rotating member has a through hole formed therethrough; a distance is defined between a center of the through hole and a center of the rotating member;, a spindle passes through the through hole; two crank arms are respectively connected to two ends of the spindle; a flywheel is rotatably assembled on the main device; the flywheel contacts the wheel member so that the flywheel is rotated by the rotation of the wheel member, a second connecting member connects the flywheel and the rotating member, so as to drive the rotating member to rotate.

2. The exercise apparatus as claimed in claim 1, wherein the resistance force created by the resistance device is adjustable.

3. The exercise apparatus as claimed in claim 1, wherein the wheel member is made of metal material; the resistance device is magnetic and doesn't contact the wheel member; a controller member drives the resistance device to move toward or from the wheel member so as to adjust the resistance force.

4. The exercise apparatus as claimed in claim 1, wherein the seat member is assembled on the main device via a seat tube member; the seat tube member is axially movable relative to the main device, so that the user can adjust a position of the seat member on the main device.

5. The exercise apparatus as claimed in claim 1, wherein the handle member is assembled on the main device via a handle tube member; the handle tube member is axially movable relative to the main device, so that the user can adjust a position of the handle member on the main device.

6. The exercise apparatus as claimed in claim 1, wherein a brake device is assembled near the wheel member; the brake device is configured to reduce the speed of the rotation of the wheel member.

7. The exercise apparatus as claimed in claim 1, wherein the flywheel can be removed from the wheel member.

* * * * *